US005961869A

United States Patent [19]

Irgens

[11] Patent Number: 5,961,869

[45] Date of Patent: Oct. 5, 1999

[54] ELECTRICALLY INSULATED ADHESIVE-COATED HEATING ELEMENT

[76] Inventor: O. Stephan Irgens, 1127 Olive Lake Dr., St. Louis, Mo. 63132

[21] Appl. No.: 08/556,539

[22] Filed: Nov. 13, 1995

[51] Int. Cl.[6] ..... H05B 3/34

[52] U.S. Cl. ..... 219/549; 219/213; 219/544

[58] Field of Search ..... 219/213, 528, 219/536, 542, 544, 549, 203; 338/254, 256, 257, 306–309; 427/208.4, 58; 428/41.8, 42.2, 343, 352, 344; 156/71, 273.9, 274.2, 307.7, 309.6, 309.9, 320

[56] References Cited

U.S. PATENT DOCUMENTS

| | | | |
|---|---|---|---|
| 2,241,312 | 5/1941 | Luty | 156/273.9 |
| 3,157,097 | 11/1964 | Stinnett, Jr. et al. | 219/528 |
| 3,239,403 | 3/1966 | Williams et al. | 156/273.9 |
| 3,757,087 | 9/1973 | Bernard | 219/549 |
| 4,251,712 | 2/1981 | Parr | 219/213 |
| 4,488,033 | 12/1984 | Trachtenberg | 219/203 |
| 4,645,146 | 2/1987 | Hall | 156/273.9 |
| 4,656,339 | 4/1987 | Grise | 219/528 |
| 4,661,689 | 4/1987 | Harrison | 219/528 |
| 4,677,801 | 7/1987 | Bard | 219/213 X |
| 4,725,717 | 2/1988 | Harrison | 219/549 X |
| 4,818,312 | 4/1989 | Benge | 156/273.9 |
| 4,910,388 | 3/1990 | Lorenz et al. | 219/543 |
| 5,015,824 | 5/1991 | Monter et al. | 219/549 |
| 5,100,494 | 3/1992 | Schmidt | 156/273.9 |
| 5,313,034 | 5/1994 | Grimm et al. | 156/274.2 |
| 5,444,228 | 8/1995 | Gelus | 219/528 |
| 5,624,750 | 4/1997 | Martinez et al. | 428/344 |

FOREIGN PATENT DOCUMENTS

| | | |
|---|---|---|
| 2070456 | 9/1992 | Canada . |
| 242787 | 10/1987 | European Pat. Off. . |
| 486891 | 5/1992 | European Pat. Off. . |
| 486892 | 5/1992 | European Pat. Off. . |
| 2052224 | 1/1981 | United Kingdom . |
| 2228165 | 8/1990 | United Kingdom . |

*Primary Examiner*—Tu Ba Hoang
*Attorney, Agent, or Firm*—Armstrong Teasdale LLP; Scott R. Hayden

[57] ABSTRACT

An improved plastic heating element of the type including comprising an elongate web of flexible, electrically conductive plastic, having two electrodes embedded therein extending longitudinally adjacent each side edge. An electrically insulating adhesive layer covers the surfaces of the heating element.

8 Claims, 2 Drawing Sheets

ELECTRICALLY INSULATED ADHESIVE-COATED HEATING ELEMENT

BACKGROUND AND SUMMARY OF THE INVENTION

This invention relates to flexible heating elements, and in particular to flexible plastic heating elements.

Flexible plastic heating elements have been known for a number of years, and have been satisfactorily employed in a number of applications, particularly in heating elements for floors. These elements comprise an elongate web of an electrically conductive plastic, such as a polyethylene and carbon black mixture. There are electrodes embedded in the web, extending longitudinally adjacent each edge. These electrodes may be, for example, a braided wire. The electrodes allow a potential to be applied transversely across the web, thereby generating heat. There are a plurality of slots extending transversely across the web, to increase the flexibility of the web and decrease the cross sectional area of the web.

An example of this prior art heating element is the STEP WARMFLOOR™ heating element available from Electro Plastics, Inc., 1780 Beltway Drive, St. Louis, Mo. 63114. These heating elements are made from an electrically conductive butyl soluted low density polyethylene. These heating elements are typically installed on a layer of adhesive applied to the floor. An insulating layer is applied over the heating element, and then leveling compound used to level the floor before the finished floor covering, e.g., wood, tile, or carpet, is installed. These heating elements are becoming increasingly popular because they operate at relative low voltages (24 volts in most applications), and are to some extent self regulating because as the temperature of the element increases, the resistance increases, decreasing the current and thus the heat being generated. Moreover, the use of these heating elements in floors provides a more even heat distribution, greater comfort, less temperature stratification, better control and increased ability to provide zoning, and the elimination of forced air which can circulate dust and germs. Because the plastic heating element is electrically conductive, there have been some concerns that in some applications the heating element should be electrically insulated.

According to the heating element of the present invention, a flexible plastic heating element is provided with an electrically insulating coating of an adhesive, preferably a pressure sensitive adhesive, and most preferably a latex-based pressure sensitive adhesive. The adhesive not only secures the heating element to the substrate on which it is placed and secures the floor covering to the heating element, but it electrically insulates the element. Thus the improved heating element is ideally suited for use in floors where the adhesive secures the element to the substrate, and secures a covering, such as carpet or tile, to the element.

The improved flexible heating element of the present invention can be made quickly and inexpensively by coating a conventional plastic heating element with an adhesive. Removable protective sheeting can be applied over the top and bottom surfaces of the heating element to facilitate handling the heating element until it is installed, and to protect the insulating adhesive coating. The heating element of the present invention thus has all of the advantages of the prior art flexible plastic heating elements, with the added advantages of being electrically insulated and self-adhesive.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
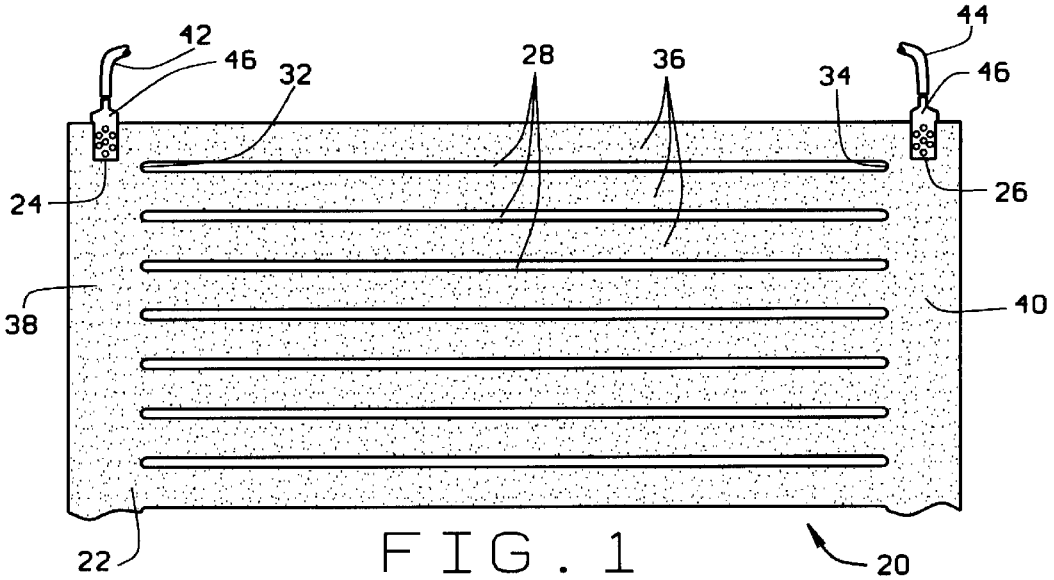
FIG. 1 PRIOR ART
FIG. 1 is a top plan view of a conventional flexible plastic heating element.
Figure 2:
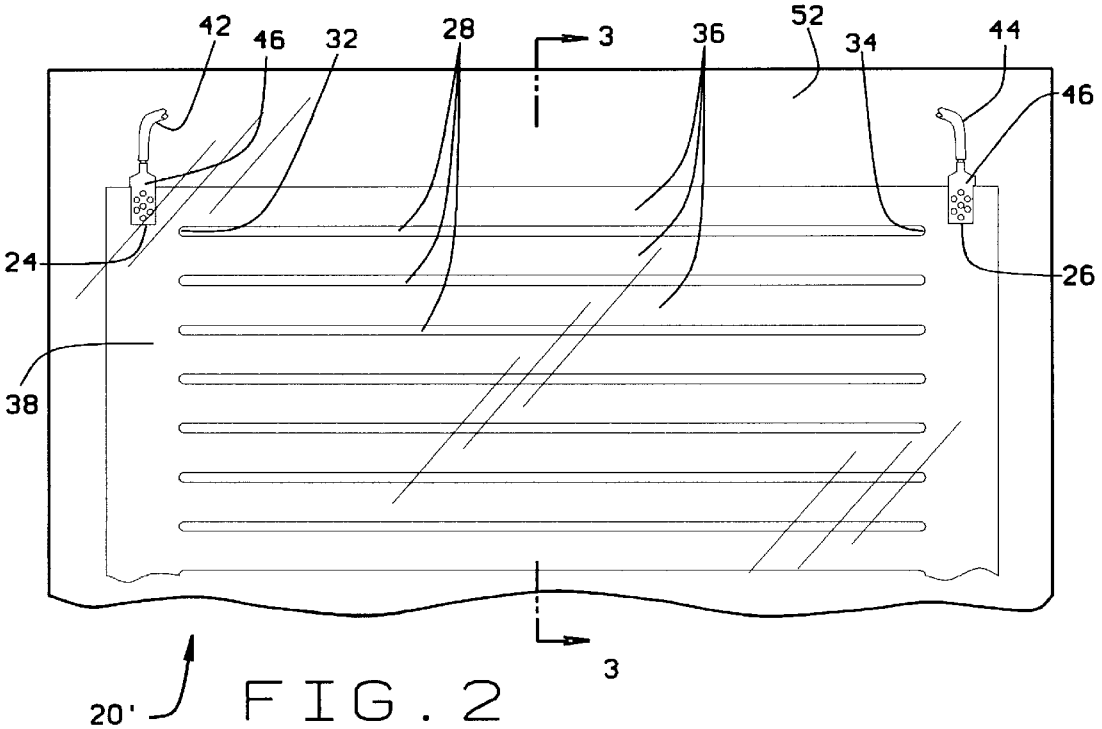
FIG. 2 is a top plan view of the improved flexible plastic heating element constructed according to the principles of the present invention.

A conventional flexible heating element is indicated generally as 20 in FIG. 1. The heating element 20 comprises an elongate web 22 of a flexible, electrically conductive plastic, such as a mixture of polyethylene mixed with carbon black. There are two longitudinally electrodes 24 and 26 embedded in the web, one adjacent each side edge. These electrodes may be, for example, a braided wire. The web has a plurality of transversely extending slots 28 therein. The slots 28 extend substantially across the width of the web and preferably have a constant width, except at their rounded ends 32 and 34. The slots 28 define a plurality of transversely extending "rungs" 36 which extend between longitudinally extending "rails" 38 and 40 in which the electrodes 24 and 26 are embedded. An example of such an electrode is the STEP WARMFLOOR™ heating element, available from Electro Plastics, Inc., 1780 Beltway Drive, St. Louis, Mo. 63114. These elements are 13⅜ inches (34 cm) wide, and 3/64 inch (1.2 mm) thick, and come in lengths as long as 23 feet (7 m). These elements are made from a butyl soluted low density polyethylene and carbon black. Lead wires 42 and 44 are physically secured to the element 20, and are electrically connected to the electrodes 24 and 26, respectively, with crimped contacts 46.

According to the principles of this invention, a flexible plastic heating element such as heating element 20' is electrically insulated by coating the element 20' with a layer of an electrically insulating adhesive. A suitable adhesive is a latex-based pressure sensitive adhesive, such as Covinax 169-00™ available from Franklin International, 2020 Bruck Street, Columbus, Ohio. This is a polyvinyl alcohol stabilized vinyl acrylic copolymer emulsion that can be conveniently applied with foam roller to the element. The adhesive coats all the external surfaces of the element, including the side edges and the edge of the slots. When the adhesive dries an electrically insulating adhesive layer 50 approximately 0.046 mm thick remains on the external surfaces of the element.

The adhesive layer 50 is preferably covered with protective sheets 52 and 54, which can be, for example, polyethylene sheets having a silicone release agent on the contact surfaces.

The insulated heating elements 20' of the present invention have all of the benefits and attributes of conventional flexible plastic heating elements with the further advantage that they are self adhesive and electrically insulated. The improved heating element of the present invention is easily installed by removing the protective sheet 54 from one side of the element and applying the exposed side against the surface on which the heating element is to be mounted. Typically, the heating element 20' would be mounted on a floor F, but it could also be mounted on a wall or other surface. The protective sheet 52 on the other side of the element is left on the element 20' to protect the tackiness of the adhesive and the integrity of the layer 50 until a cover is to be applied over the element, for example, a carpet. The sheeting 52 can be removed, and the adhesive layer actually helps retain the carpet C over the heating element 20'.

OPERATION

Figure 3:
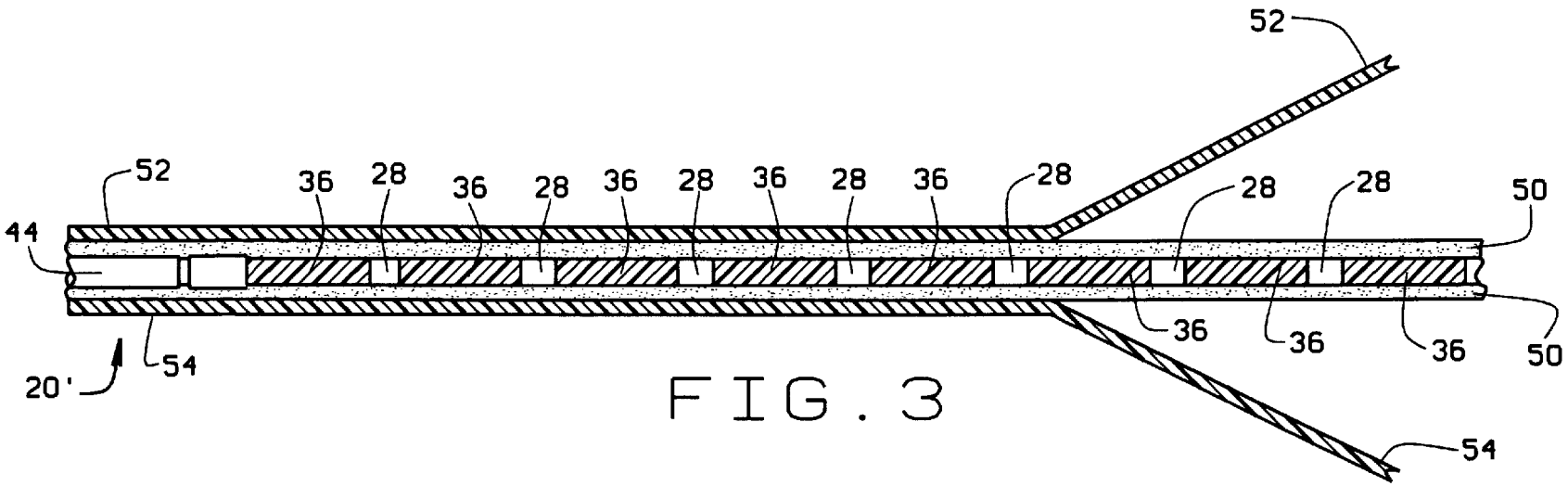
FIG. 3 is a partial longitudinal cross-sectional view of the improved flexible plastic heating element taken along the plane of line 3—3 in FIG. 2.
Figure 4:
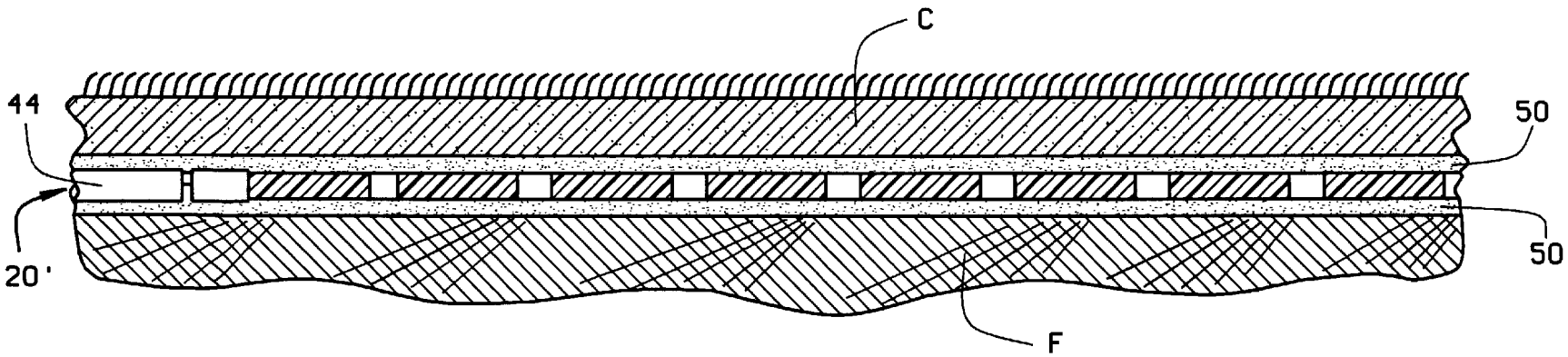
FIG. 4 is a partial longitudinal cross-sectional view of the improved heating element shown as it would be secured on a floor and covered with a carpet.

In operation, the surface on which the heating element 20' as illustrated in FIG. 3, is to be mounted, for example, floor F, is cleaned and prepared. The protective sheet 54 is peeled from the heating element 20', and the heating element is positioned and pressed against the floor F to secure it. The lead wires 42 and 44 can be connected to a transformer and the installation of other heating elements 20' can be completed while the protective sheet 52 remains in place.

When the covering is ready to be installed, the protective sheet 52 is peeled away as illustrated in FIG. 3, and a carpet C is secured over the element. The adhesive layer 50 helps secure the carpet C on the floor F. Alternatively, leveling compound, grout, or some other adhesive can be placed over the heating element 20'.

The adhesive layer 50 covering the exposed surfaces of the heating element 20' helps electrically insulate the heating element, secure the element on the surface, and secure a covering over the element.

What is claimed is:

1. An improved plastic heating element of the type comprising an elongate web of flexible, electrically conductive plastic, having two electrodes embedded therein extending longitudinally adjacent each side edge, and a plurality of transverse slots therein, the element having a top surface, a bottom surface, edge surfaces, and slot edge surfaces, the improvement comprising an electrically insulating adhesive coating all said surfaces of the element, including the slot edge surfaces.

2. The improved heating element of claim 1 wherein the flexible plastic web comprises a mixture of polyethylene and carbon black.

3. The improved heating element of claim 1 wherein the adhesive is a pressure sensitive adhesive.

4. The improved heating element of claim 1 wherein electrodes each comprise a braided wire.

5. A flexible plastic heating element comprising an elongate flexible plastic web, two electrodes embedded in the web extending longitudinally adjacent each side edge, a plurality of transverse slots therein, and an electrically insulating adhesive coating, said element having a top surface, a bottom surface, edge surfaces, and slot edge surfaces, said electrically insulating adhesive coating covering all said surfaces of the element, including the slot edge surfaces.

6. The heating element of claim 5 wherein the flexible plastic web comprises a mixture of polyethylene and carbon black.

7. The improved heating element of claim 5 wherein the electrodes each comprise a braided wire.

8. A method of installing a flexible plastic heating element between a substrate and a covering comprising the steps of:

providing an elongate flexible plastic heating element web comprising a plurality of transverse slots therein, top, bottom, edge, and slot edge surfaces, and an electrically insulating pressure sensitive adhesive on all the element surfaces, including the slot edge surfaces, and removable liners on the top and bottom surfaces;

removing one of the liners and applying the exposed surface of the heating element against the substrate to adhesively secure it to the substrate; and removing the other of the liners and applying a covering over the element.

* * * * *